US011512592B2

(12) United States Patent
Spezia

(10) Patent No.: US 11,512,592 B2
(45) Date of Patent: Nov. 29, 2022

(54) MACHINE FOR THE GENERATION OF ENERGY BY EXPLOITING THE FLOW OF FLUID

(71) Applicants: ANMC—ADVANCED NEW MATERIALS AND COMPONENTS S.R.L., Milan (IT); Raffaele Antonio Spezia, Tortona (IT)

(72) Inventor: Raffaele Antonio Spezia, Tortona (IT)

(73) Assignee: ANMC—ADVANCED NEW MATERIALS AND COMPONENTS S.R.L., Milan (IT)

( * ) Notice: Subject to any disclaimer, the term of this patent is extended or adjusted under 35 U.S.C. 154(b) by 0 days.

(21) Appl. No.: 17/262,296

(22) PCT Filed: Jul. 22, 2019

(86) PCT No.: PCT/IB2019/056231
§ 371 (c)(1),
(2) Date: Jan. 22, 2021

(87) PCT Pub. No.: WO2020/021426
PCT Pub. Date: Jan. 30, 2020

(65) Prior Publication Data

US 2021/0332703 A1 Oct. 28, 2021

(30) Foreign Application Priority Data

Jul. 23, 2018 (IT) ..... 102018000007430

(51) Int. Cl.
*F01D 1/36* (2006.01)
*F01D 5/02* (2006.01)

(52) U.S. Cl.
CPC ..... *F01D 1/36* (2013.01); *F01D 5/028* (2013.01); *F05D 2220/30* (2013.01); *F05D 2240/242* (2013.01)

(58) Field of Classification Search
CPC ... F01D 1/34; F01D 1/36; F01D 5/028; F01D 5/043; F05D 2240/242
See application file for complete search history.

(56) References Cited

U.S. PATENT DOCUMENTS 1,210,831 A * 1/1917 Pfeiffer ..... F02C 3/165 60/39.35
5,192,182 A * 3/1993 Possell ..... F01D 1/36 415/143
2021/0332703 A1* 10/2021 Spezia ..... F01D 5/028

* cited by examiner

*Primary Examiner* — Christopher R Legendre
(74) *Attorney, Agent, or Firm* — Nixon & Vanderhye

(57) ABSTRACT

A machine for generating energy by exploiting the flow of a fluid. The machine includes a first fixed or static component part or stator which defines a first cylindrical inner surface and a second outer surface. The machine further includes a second component part or rotor configured to be rotated and accommodated in the inner space confined by the first cylindrical inner surface. The first fixed or static component part or stator is configured to introduce a fluid into the inner space confined by the first inner surface through the second outer surface and first inner surface of the stator, such that the interaction between the flow of fluid introduced into the inner space and the second component part or rotor results in the second component part or rotor being rotated.

15 Claims, 13 Drawing Sheets

MACHINE FOR THE GENERATION OF ENERGY BY EXPLOITING THE FLOW OF FLUID

CROSS REFERENCE TO RELATED APPLICATION

This application claims benefit under 35 U.S.C. § 371 to international application No. PCT/IB2019/056231 filed on Jul. 22, 2019, which claims priority to Italian application No. 102018000007430 filed Jul. 23, 2018, the contents of which are incorporated by reference in their entireties.

TECHNICAL FIELD

The present invention relates to the field of energy generation by exploitation of the flow of a fluid. In particular, the present invention relates to a machine or device for converting the energy of a fluid into mechanical energy. In particular, the present invention relates to a machine of aforesaid type, for example but not exclusively a turbine, comprising an innovative solution for the optimal and improved conversion of the energy of a fluid in motion into energy or mechanical work.

BACKGROUND ART

Machines capable of converting the intrinsic energy of a fluid in motion (kinetic energy or enthalpy) into energy or mechanical work are known and used in the prior art for various purposes according to their size.

An example of these machines, also named dynamic fluid machines, are Tesla turbines (named after the inventor), which are widely and satisfactorily used in various sectors of mechanics, particularly in form of small and/or very small machines.

The aforesaid machines, in particular the Tesla turbines according to the prior art, are based on the transformation of the energy contained in a fluid in motion, and therefore in a flow of fluid (e.g. air, and/or gas and/or steam), into mechanical energy and vice versa, wherein an adequate and optimal interaction between the fluid and a mechanical member capable of being rotated (the rotor) is necessary in order to obtain the desired transformation, and wherein the rotation of the rotor takes place by virtue of the viscosity of the fluid but is still dependent on the manner by which the fluid is guided against the rotor, usually by means of a fixed component part of the turbine called stator.

In practice, the degree of transformation of the fluid energy into mechanical energy, and therefore the efficiency of the turbine or machine, depends on the manner by which the flow is guided against the rotor, wherein one of the determining factors of turbine efficiency is represented by the conformation of the stator, usually ring-shaped, wherein the fluid in motion outside the stator is guided by the stator itself against the rotor, the stator being equipped, for the purpose, with a number of through holes or nozzles which connect the space in which the rotor is housed with the space outside the stator.

Although satisfactory from many points of view, e.g. such as reliability, the known machines are not exempt from problems and/or disadvantages that the present invention intends to overcome or at least to reduce or minimize.

A first drawback relates to the fact that in most known machines, and especially in those of small size, the stator, especially if obtained by mechanical machining from a billet (by means of a drill or the like), has a limited number of nozzles, wherein the minimum size of the nozzles and their mutual distance are, on the contrary, too high, so that zones in which there is flow (the nozzles or holes) and zones (full) in which there is no flow are inevitably present along the extension of the rotor/stator boundary zone; however, this alternation causes vortices and strong frictions on the walls because the radial speed component is not null and the speed gradient itself can reach very high values, also in this case with large losses of performance.

Another serious problem affecting the known machines or turbines is their (excessive) lack of flexibility; indeed, it is apparent that a stator, especially if obtained by machining an original billet, is a unique piece which cannot be modified and which can be implemented in one only machine or turbine because it cannot be used on turbines with specifications differing from those of the machine for which it was originally designed and built.

Furthermore, a further problem found in stators according to the prior art is related to the inevitable tolerances, wherein it is practically impossible to obtain perfectly identical stators, especially by machining an original billet, i.e. with holes or nozzles all with the same diameter and at the desired mutual distances, wherein the unevenness in the dimensions and/or mutual distances results in the equally inevitable presence of different flows (in terms of flow rate, speed, direction etc.) in the boundary zone between stator and rotor, and therefore still with the aforesaid losses of efficiency.

Finally, a further problem found in the prior art is represented by the manufacturing times of the stator, especially but not exclusively if it is made by machining an original billet, said times being far too high with consequent obvious repercussion on production costs, often impractical for applications of wider use.

DESCRIPTION OF THE PRESENT INVENTION

It is thus the object of the present invention to overcome or at least minimize the drawbacks affecting the solutions according to the prior art, in particular dynamic fluid machines or turbines according to the prior art for converting the energy of a fluid in motion into mechanical energy, in particular in the rotation of a rotor.

In particular, it is an objective or object of the present invention that of providing a machine of the aforesaid type in which the fluid flow is distributed virtually seamlessly throughout the stator-rotor boundary zone.

It is a further object of the present invention also to distribute the points of introduction of the motive fluid along the entire boundary zone, so as to minimize the sliding thereof on the walls, thereby limiting losses by friction on parts which do not generate work and/or to maximize the speed components which are not tangent to the surfaces.

It is a further purpose of the present invention to provide a stator which can be manufactured in a simple and immediate manner (in particular not necessarily by machining an original billet) and at low cost, and is also characterized by high and improved reproducibility in terms of both the overall size of the stator itself, and in terms of size and/or distance and/or reciprocal shape of the holes or nozzles.

Furthermore, the stator according to the present invention shall adapted to be modified according to the needs and/or circumstances.

The present invention is based on the various general considerations briefly summarized below.

The desired uniformity of the fluid flow can be obtained by means of a substantially "porous" stator, i.e. in which the nozzles are very high in number (in the order of even several hundred) and very small in size.

A substantially "porous" stator can be obtained at a reasonable cost using alternative technologies to both machining from billet and 3D printing (which do not guarantee the desired accuracy and require very long printing times).

A substantially "porous" stator with the desired characteristics can be obtained by means of "additive" technology according to which previously processed, substantially identical elements are added to each other.

The substantially identical elements to be "added", in practice to be superimposed, can be processed beforehand using low-cost technologies, such as metal chemical photoengraving (photoetching), which ensure very small size machining with maximum precision.

In view of the drawbacks found in the solutions according to the prior art, of the objects summarized above, and of the conditions illustrated hereto, a machine according to claim 1 is suggested according to the present invention.

According to an embodiment, the present invention relates to a machine for generating energy by exploiting the flow of a fluid, said machine comprising a first fixed or static component part or stator which defines a first substantially cylindrical inner surface and a second outer surface, said machine further comprising a second component part or rotor adapted to be rotated and accommodated in the inner space confined by said first substantially cylindrical inner surface, said first fixed or static component part or stator being shaped so as to allow the introduction of a fluid into the inner space confined by said first inner surface through said second outer surface and first inner surface, wherein the interaction between said flow of fluid introduced into said inner space and said second component part or rotor results in said second component part or rotor being rotated; wherein said first fixed or static component part or stator comprises a plurality of overlapping lamellar elements, wherein at least one of said lamellar elements is shaped so as to define non-contact areas with a lamellar element adjacent thereto, and therefore so as to define, with the lamellar element adjacent thereto, a plurality of passages for said fluid, wherein each of said passages puts into communication said inner space with the space outside said second outer surface.

According to an embodiment, said at least one lamellar element which defines said non-contact areas with the lamellar element adjacent thereto, defines a substantially flat main surface, from which a plurality of protrusions extends.

According to an embodiment, the thickness of said protrusions is substantially equal to the thickness of said at least one lamellar element at said non-contact areas subtended from said main surface.

According to an embodiment, the thickness of said protrusions is from 0.002 to 2.00 millimeters, preferably from 0.01 to 0.5 millimeters, even more preferably from 0.025 to 0.3 millimeters.

According to an embodiment, said protrusions each have an elongated plan shape with a longitudinal development along a directrix perpendicular to the longitudinal symmetry axis of said first substantially cylindrical fixed component part or stator.

According to an embodiment, each of said protrusions comprises a first end portion arranged substantially at said first inner surface.

According to an embodiment, each of said protrusions comprises a second end portion arranged at a predetermined distance from said second outer surface.

According to an embodiment, said second end portion of each of said protrusions is hook-shaped and defines an end tip facing said second outer surface.

According to an embodiment, the longitudinal extension directrix of each of said protrusions is substantially tangential to said first inner surface and intersects said second outer surface.

According to an embodiment, the two protrusions of each pair of adjacent protrusions partially overlap each other according to a radial direction perpendicular to the longitudinal symmetry axis of said first fixed component part or stator.

According to an embodiment, said protrusions are obtained by chemically photoengraving a lamellar element of substantially uniform thickness.

According to an embodiment, each of said lamellar elements comprises at least two through-holes, wherein said lamellar elements are mutually fixed by fixing means, which extend through said at least two through-holes of said lamellar elements.

According to an embodiment, said lamellar elements are fixed to one another by one of the following methods:

by stacking them (superimposing them) inside a casing provided with a removable cover, wherein said elements are packed between the casing and the cover and tightened together by the action of tie rods or threads which are adapted to approach casing and cover thereby compressing the laminated elements;

or by stacking them (superimposing them) inside an outer casing made up of two or more parts, wherein said elements are packed and tightened together by the elements of the casing by means of the action of tie rods or screws or threads to tighten and approach the parts of the outer casing, thereby compressing and packing the lamellar elements together;

or by stacking them inside a casing made up of two or more parts and clamping elements proper to the casing, wherein said elements are packed and clamped together under the bias of the clamping systems themselves as the casing elements, thereby compressing and packing the laminated elements together.

According to an embodiment, said second component part or rotor comprises a main body accommodated in said inner space and consisting of a plurality of overlapping discoid elements, wherein the discoid elements of each pair of adjacent discoid elements are placed at a mutual predetermined distance.

According to an embodiment, said second component part or rotor comprises a main body accommodated in said inner space and consisting of a plurality of radial blades.

According to an embodiment, the outer edges in radial direction of said blades lie on a common frustoconical surface.

Further possible embodiments of the present invention are defined in the claims.

BRIEF DESCRIPTION OF THE FIGURES

In the following, the present invention will be explained by means of the following detailed description of the embodiments depicted in the drawings. However, the present invention is not limited to the embodiments described in the following and depicted in the drawings; on the contrary, all the variants of the embodiments described below and depicted in the drawings which will be apparent to a person skilled in the art have to be regarded as falling within the scope of the invention.

In the drawings.

DETAILED DESCRIPTION OF THE PRESENT INVENTION

The present invention is particularly advantageously when implemented in the field of machines for converting the energy of a fluid into mechanical energy, this being the reason why, in the following, the present invention will be clarified with (possible) reference to its application to the case of the aforesaid machines, in particular to Tesla type turbines, in all cases the possible applications of the present invention not being limited to the aforesaid machines nor to Tesla type turbines.

Figure 1A:
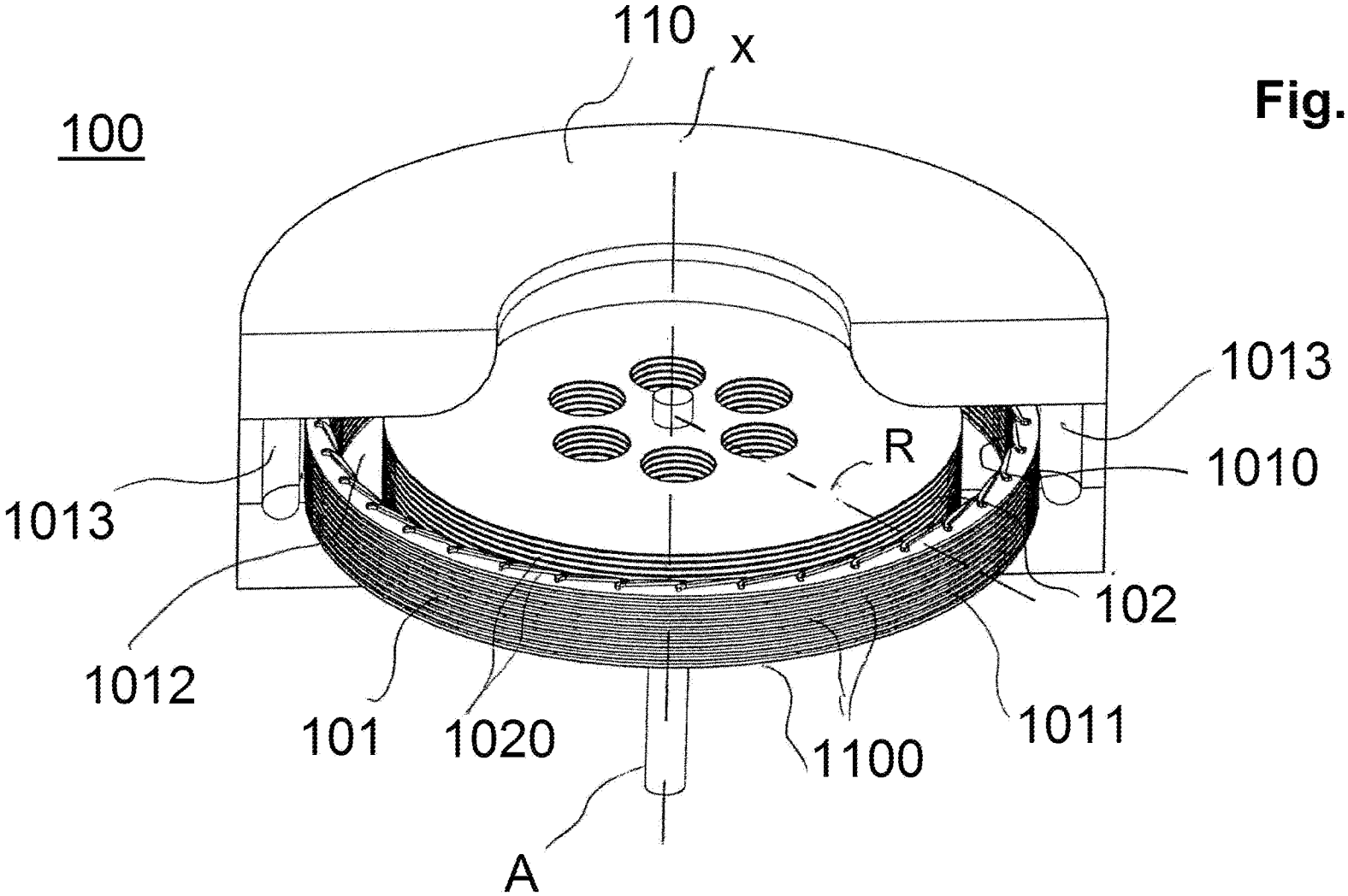
FIGS. 1*a* and 1*b* each show a perspective view in partial section of a machine according to an embodiment of the present invention.
Figure 1B:
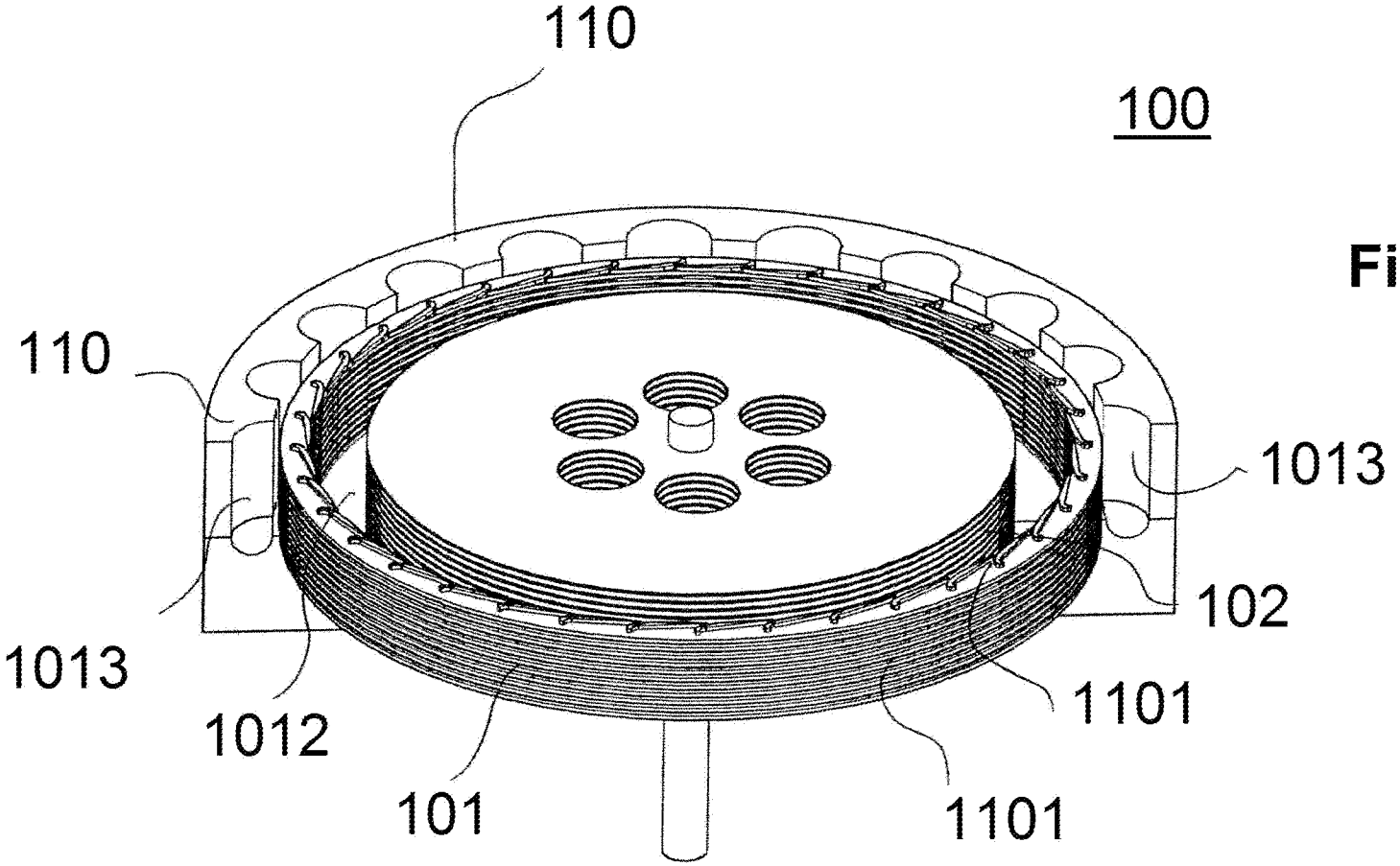

The machine 100 depicted in FIGS. 1*a* and 1*b* comprises a fixed outer casing or container 110, in which a first fixed component or stator 101 and a second rotatable component or rotor 102 are housed.

The stator 101 has a substantially cylindrical annular shape and therefore either defines or comprises a substantially cylindrical inner surface of predetermined diameter 1010, and an essentially cylindrical outer surface of predetermined diameter 1011, the diameter of the surface 1011 being obviously greater than that of the inner surface 1010, wherein the difference between the radius of the surface 1011 and that of the surface 1010 defines the thickness of the stator 101 along the direction R perpendicular to the longitudinal symmetry axis X of the stator 101.

The rotor 102, as depicted, is housed in the inner space 1012 defined and/or confined by the inner surface 1010 of the stator 101, and is adapted to be rotated with respect to a rotation axis coinciding with the axis X, wherein the rotor 102 comprises a plurality of overlapping discoid (disc shaped) elements 1020 splined onto a rotation shaft A, the discoid elements 1020 being spaced mutually along the shaft A, wherein each pair of adjacent discoid elements 1020 defines a cavity. The diameter of the rotor 102 is smaller than that of the inner surface 1010 of the stator 101, wherein there is a gap or boundary zone between stator 101 and rotor 102.

The operation of the machine 100 is substantially similar to that of the dynamic fluid machines according to the prior art, wherein, by means of the stator 101, a fluid in motion in the space 1013 outside the stator 101 (between stator 101 and outer container 110), is conveyed through the stator 101 (through a plurality of passages 1101, each of which puts the outer surface 1011 and the inner surface 1010 into communication) into the space 1012 and thus towards the rotor 102, wherein the viscosity of the fluid translates into an interaction between the fluid and the rotor 102, and thus into the rotation of the rotor 102.

As mentioned above, the efficiency of the machines of the type depicted in FIGS. 1*a* and 1*b*, and therefore the degree of transformation of the energy of the fluid into mechanical energy or work, depend on the manner by which the fluid interacts with the rotor 102, and therefore on the manner by which the fluid is conveyed by means of the stator 101 towards rotor 102.

Figure 3:
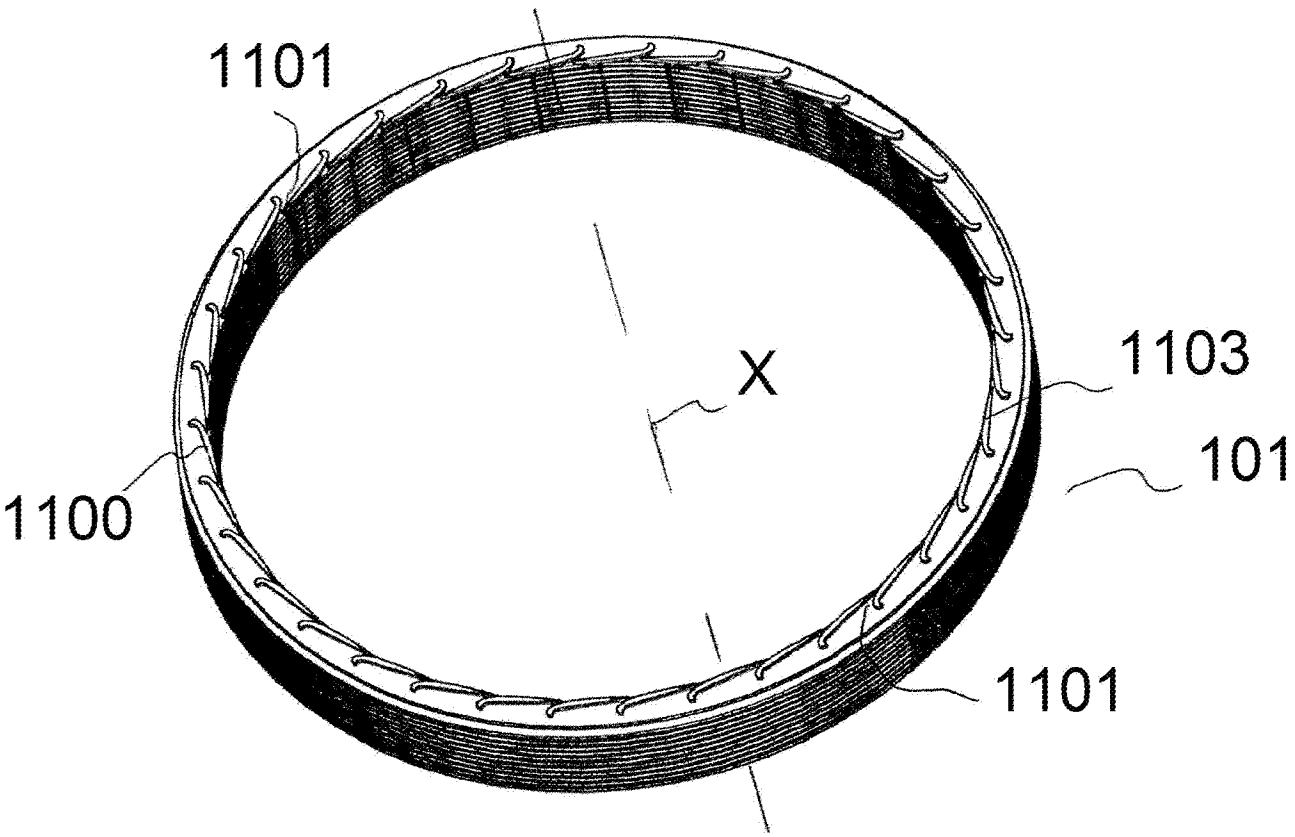
FIG. 3 shows a perspective view of a rotor of a machine according to an embodiment of the present invention.

Again, as anticipated, according to the present invention, the stator 101 has innovative features which allow optimizing the interaction mode between fluid and rotor 102; an example of said innovative characteristics or features is described hereinafter with reference to FIGS. 3 to 5, wherein characteristics or features and/or component parts of the present invention already described above with reference to other figures are identified by the same reference numerals in figures from 3 to 5.

As depicted in figures from 3 to 5, the stator 101 consists of a plurality of superimposed lamellar elements 1100, each lamellar element 1100 having a circular crown shape with an inner circumference of diameter corresponding to that of the surface 1010 and an outer circumference of diameter corresponding to that of the surface 1011.

Figure 5A:
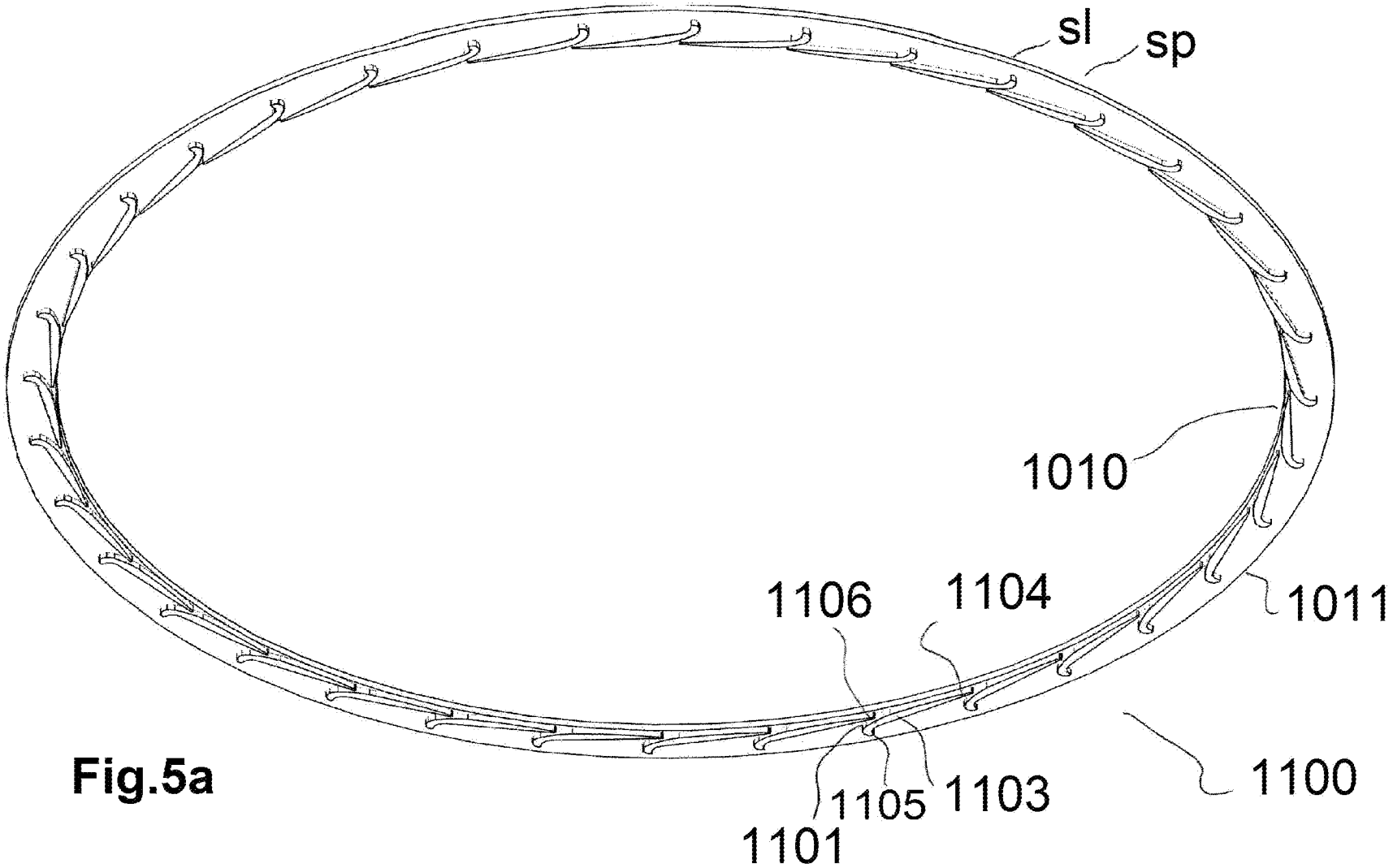
FIGS. 5*a* and 5*b* each show a plan view of a lamellar element and of a detail thereof of a rotor of a machine according to an embodiment of the present invention.

Furthermore, and again as illustratively depicted its. FIG. 5*a*, each lamellar element 1100 comprises a plurality of protrusions 1103 arranged regularly in succession along the circular development of the element 1100, wherein each protrusion 1103 extends from the main surface 1102 along a direction parallel to the axis X, each protrusion 1103 having in particular a predefined thickness sp, substantially corresponding to the thickness sl of the element 1100 in correspondence of those parts of element 1100 not subtended by (not overlapping with) protrusions 1103. Therefore, in the case, inter alia, in which the elements with protrusions 1103 are obtained by photochemical engraving (etching) and/or chemical shearing from a starting plate of substantially uniform thickness, the thickness of the protrusions 1103 will be substantially equal to half the thickness of the original plate. Furthermore, if the elements and the protrusions 1103 are obtained by chemical or photochemical engraving of a precut starting lamellar element with a substantially uniform thickness, the thickness of the protrusions 1103 will be substantially proportional to the time and action of the chemical etching. Therefore, it can be appreciated that by superimposing the lamellar elements 1100 to form the stator 101, as depicted in FIG. 3, two adjacent lamellar elements will be in mutual contact only at the protrusions 1103, wherein N−1 passages 1101 (given N the number of protrusions 1103) will be defined and identifiable between two adjacent lamellar elements 1100, wherein each passage 1101 extends from the inner circumference towards the outer perimeter of the lamellar element 1100, and wherein with the lamellar elements 1100 superimposed to form the stator 101, as depicted in FIG. 3, each passage extends between the inner surface 1010 and outer surface 1011 and thus puts the outer space 1013 and the inner space 1012 into communication.

Again, as depicted (FIGS. 4*a* to 5*b*), the protrusions 1103 are shaped and mutually arranged so that the flow of fluid through a channel 1101 defined between two adjacent protrusions 1103 is substantially tangent to the cylindrical outer surface of the rotor 102.

Figure 4A:
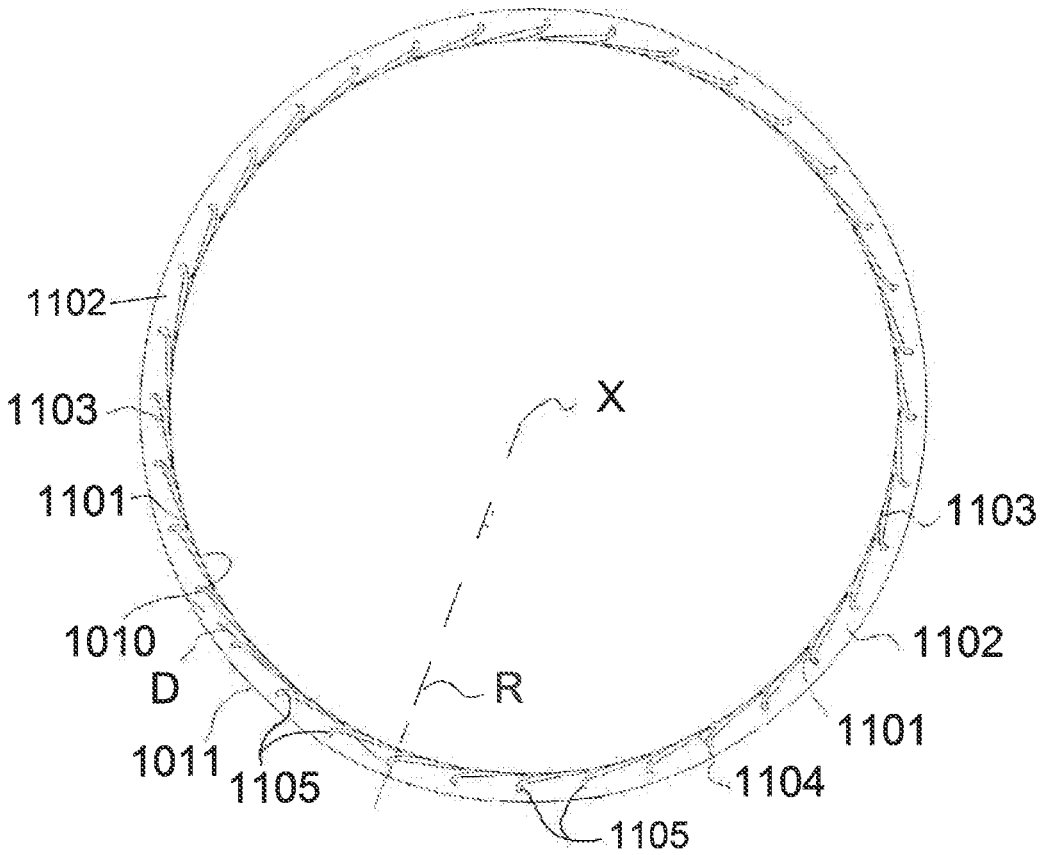
FIGS. 4*a* and 4*b* each show a plan view of a lamellar element and of a detail thereof of a rotor of a machine according to an embodiment of the present invention.
Figure 4B:
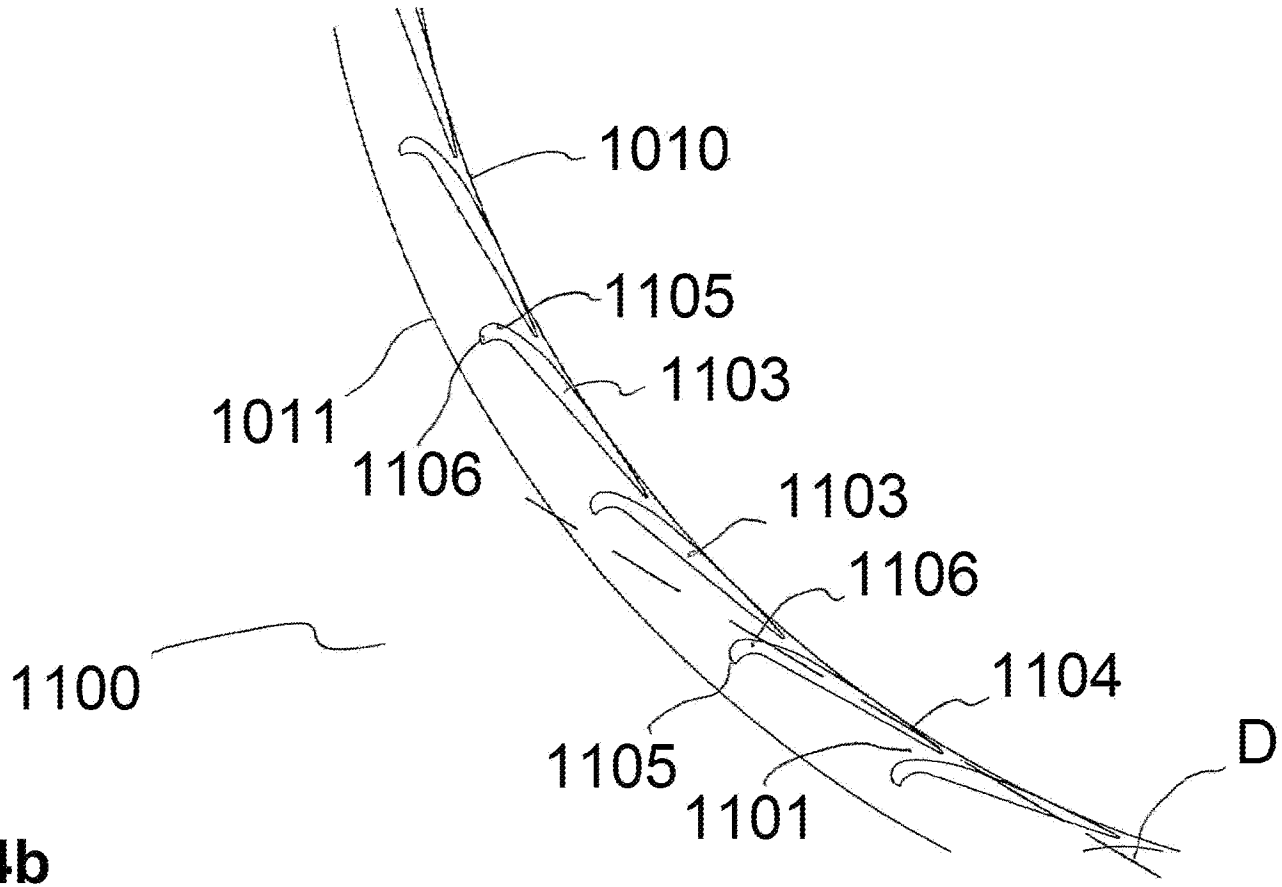
Figure 5B:
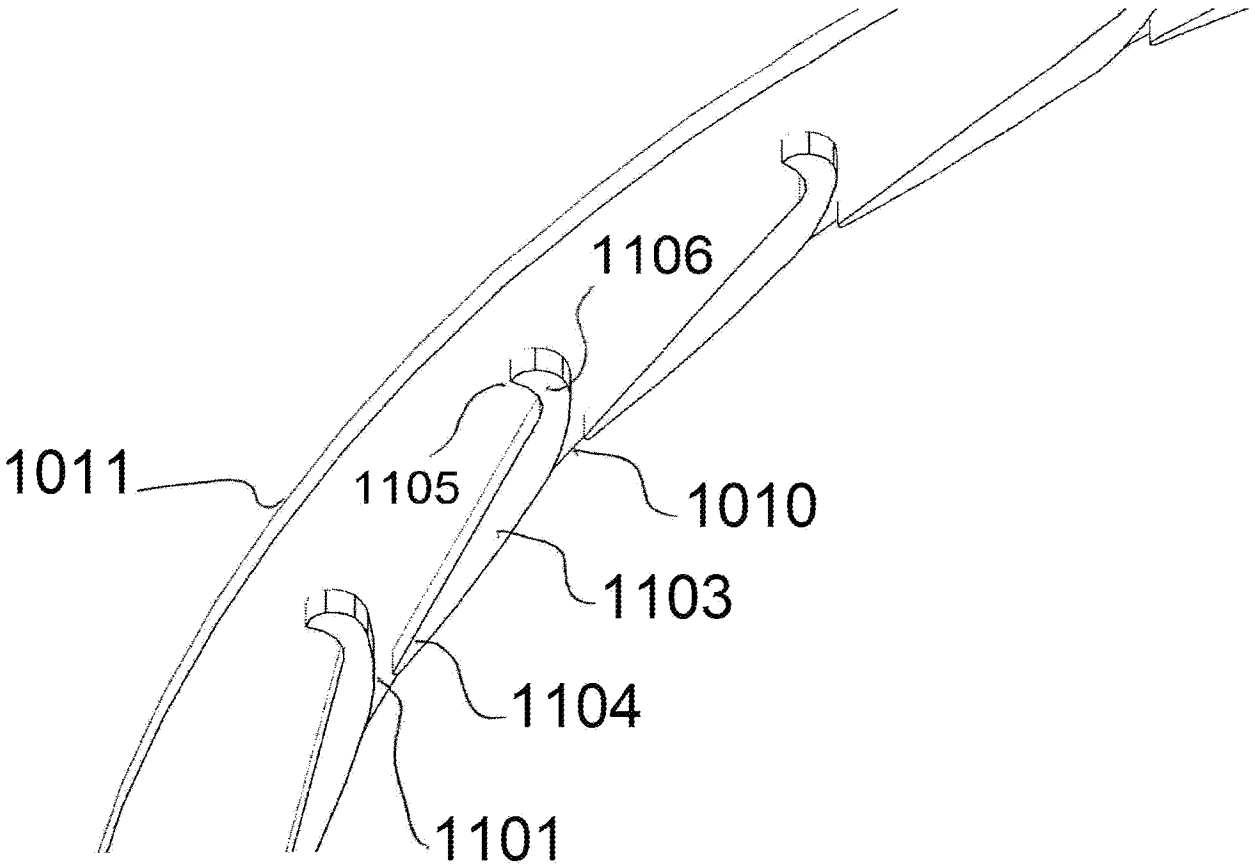

In this respect, it is worth noting first of all that each protrusion 1103 has a longitudinal extension in a plane perpendicular to the axis X along a directrix D tangent to the inner circumference of the corresponding lamellar element 1100, wherein the directrix D on the contrary intersects the outer perimeter of the lamellar element 1100 (FIG. 4*a*).

Furthermore (FIG. 4*b*), each protrusion 1103 comprises a first end portion 1104 placed at the inner circumference of the lamellar element 1100, and a second end portion 1105 opposite to the first end portion 1104 and placed at a predefined distance from the outer perimeter of the lamellar element 1100. In particular, while the first portion 1104 substantially extends along the main directrix D, the second end portion 1106 deviates from said main directrix D and is shaped as a hook with an end point 1105 facing the outer perimeter of the lamellar element 1100. Therefore, each passage 1101 comprises a larger V-shaped inlet towards the outer perimeter, and a narrower outlet towards the inner circumference of the element 1100.

Finally, as depicted, two adjacent protrusions 1103 are partially superimposed along a radial direction R, the second end portion 1106 of one of the two protrusions 1103 being superimposed on (overlapped with) the first end portion 1104 of the second protrusion 1103.

Figure 6:
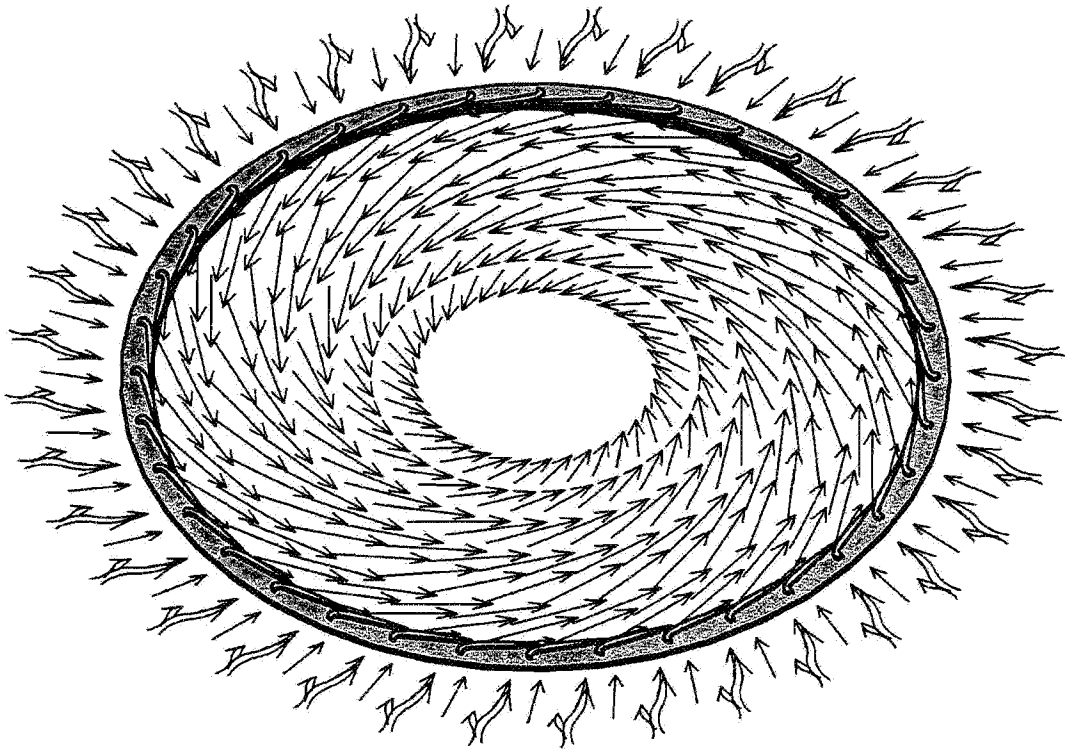
FIG. 6 diagrammatically shows the distribution of fluid flows which can be obtained by means of a stator of a machine according to an embodiment of the present invention.

The mutual conformation and arrangement of the protrusions 1103, as anticipated, allows generating, inside the stator 101, a plurality of micro-flows of fluid, one for each passage 1101, each substantially tangent to the inner surface 1010 of the stator 101, wherein each of said micro-flows intercepts the rotor 102 according to a direction substantially tangent to the outer surface of the rotor 102 (FIG. 6).

Hereafter, a further embodiment of a stator 101, which can be implemented in a machine according to the present invention, will be described with reference to figures from 7*a* to 7*c*.

As depicted, in the case of the embodiment in figures from 7*a* to 7*c*, the stator 101 again comprises a plurality of lamellar elements 1100 superimposed according to the methods described above, wherein, however, in this case, each lamellar element 1100 comprises a plurality of openings A (FIG. 7*c*) arranged in sequence with radial regularity along the circular extension of the lamellar element 1100, and wherein each opening A extends transversally to the main surface 1102 for the entire thickness sl of the element 1100, and thus so as to put the surface 1102 in communication with the corresponding opposite surface.

Figure 7A:
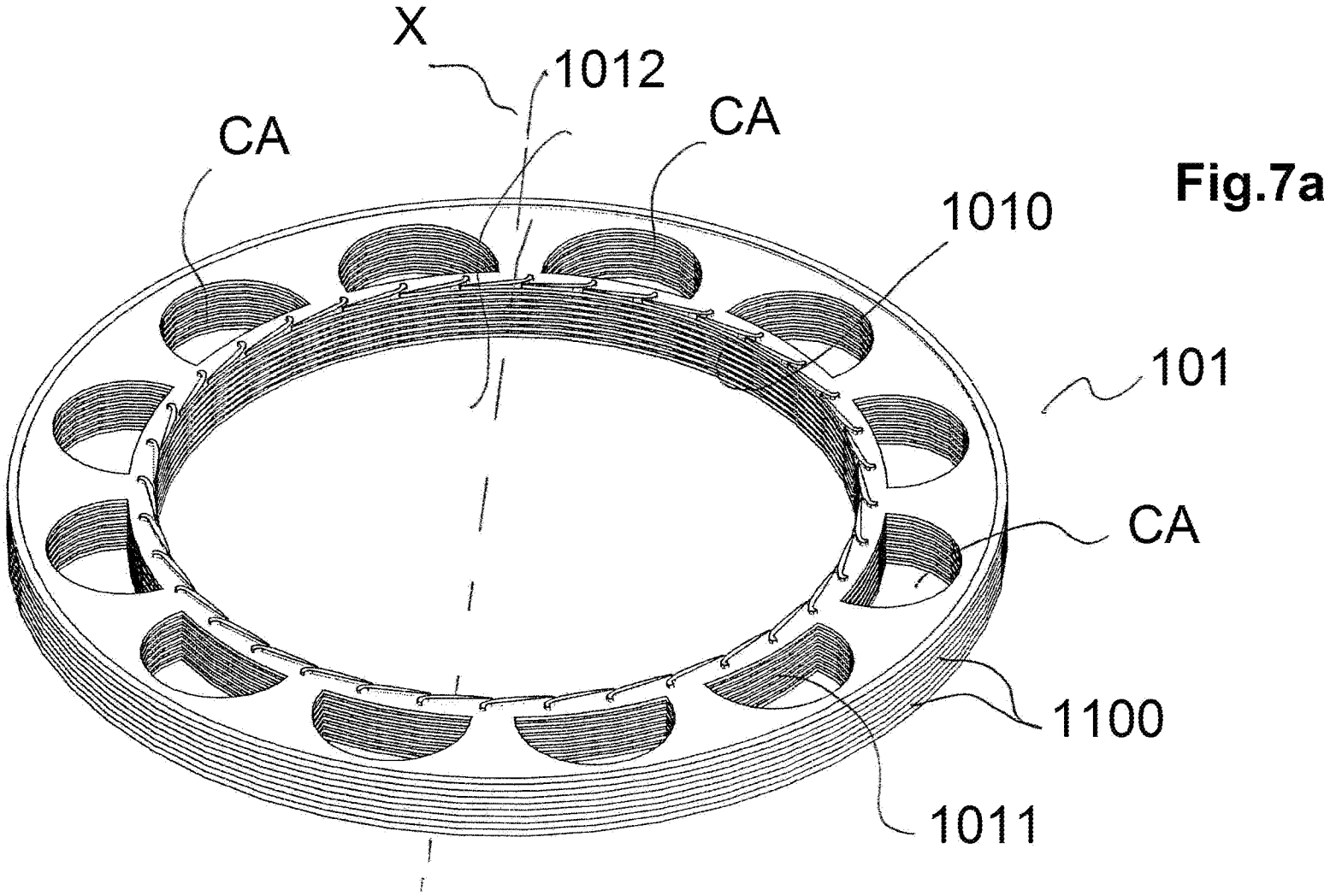
FIGS. 7*a* to 7*c* show perspective views of a stator and respectively of a lamellar element according to a further embodiment of the present invention.
Figure 7B:
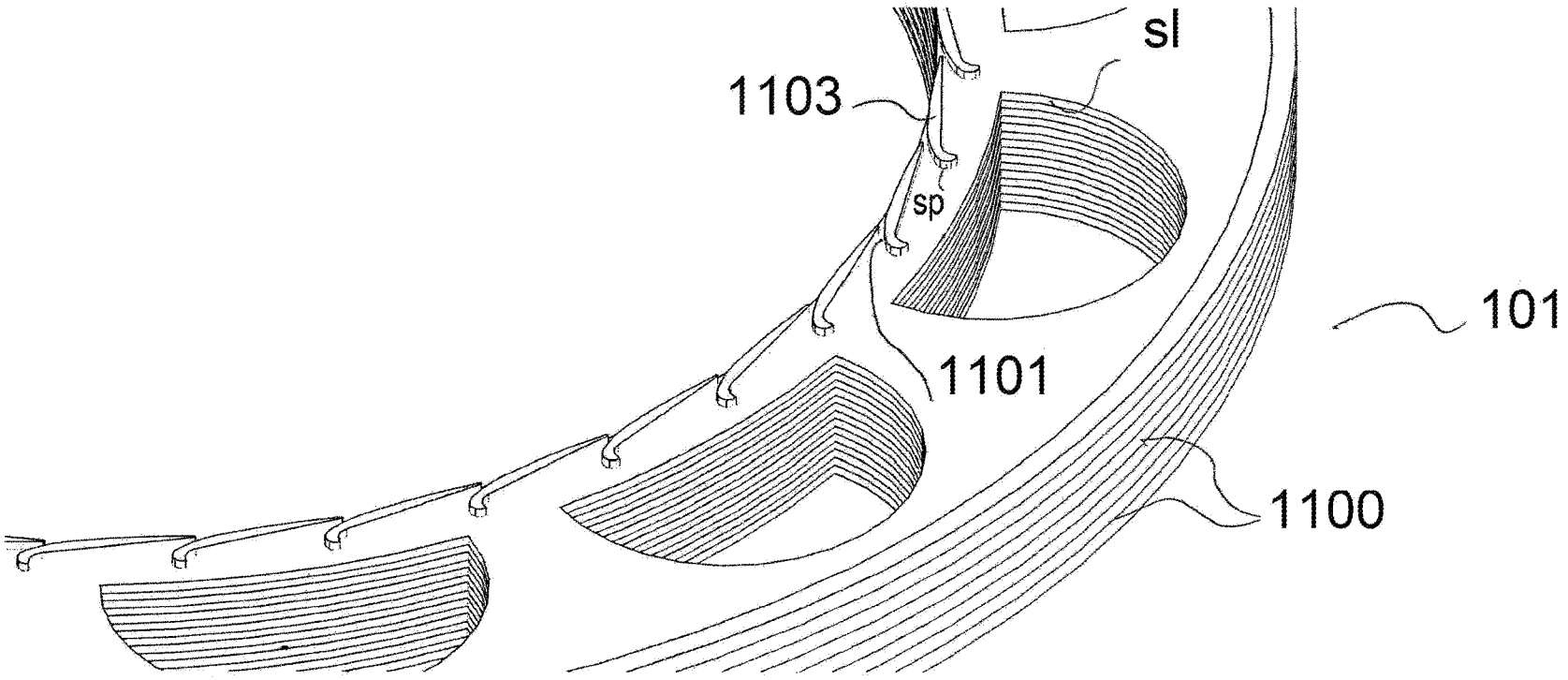
Figure 7C:
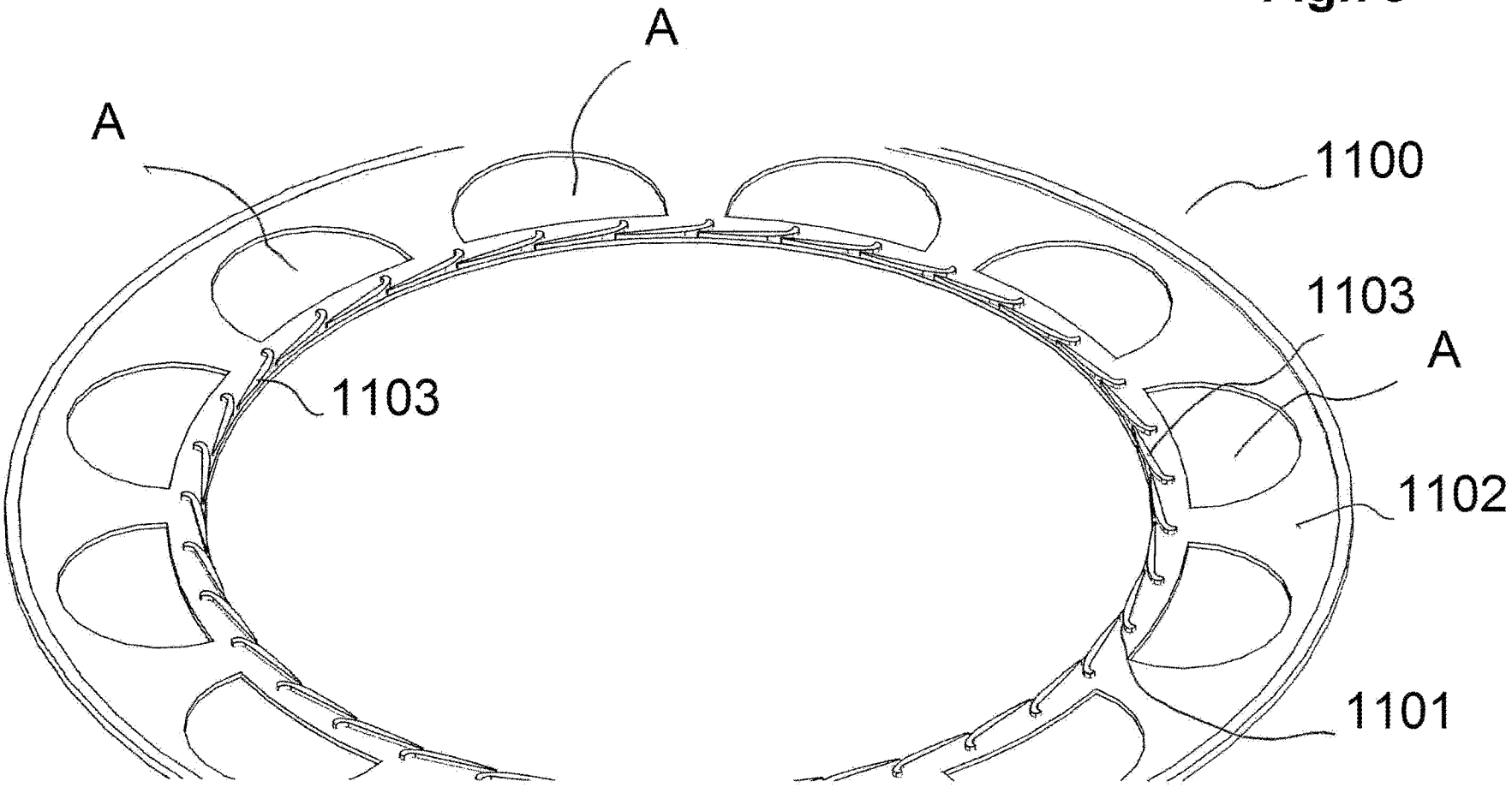

Therefore, with the lamellar elements 1100 superimposed as depicted in FIG. 7*a* to define the stator 101, the openings A (in mutual correspondence) define a corresponding plurality of channels CA which each extend parallel to the axis X, and which can be used as input channels for the introduction of the fluid into the inner space 1012 through the inner surface 1010 (again cylindrical) and the outer surface 1011 (discontinuous, in this case).

The stator 101 according to this embodiment allows avoiding the use of the outer casing 110, which is necessary, on the contrary, in the case of the embodiments described above, for defining the channels or input passages 1013.

It has thus been demonstrated by means of the above detailed description of the embodiments of the present invention as depicted in the drawings that the present invention achieves the predetermined objects by overcoming the drawbacks found in the prior art.

In particular, the present invention allows making a substantially "porous" stator, i.e. comprising a plurality of micro-passages 1011 at reasonable costs, using technologies alternative to both machining from billet and 3D printing (which do not ensure the desired precision and require very long printing times), particularly according to additive technology methods, which envisages the addition of substantially identical elements previously processed, for example, but not exclusively by photochemical engraving and/or etching.

Furthermore, by means of the present invention, a machine is made available in which the flow of fluid is distributed practically seamlessly along the entire stator-rotor boundary zone, i.e. in which the motor fluid points of injection or input are distributed along the entire boundary zone, so as to minimize the sliding of the fluid on the walls, and thus limiting friction losses on parts which do not generate work and/or which maximize the speed components which are not tangent to the surfaces.

Furthermore, the stator according to the present invention can be made in simple and immediate manner (in particular not necessarily by machining an original billet) and at low cost, and is also characterized by high and improved reproducibility in terms of both the overall size of the stator itself, and in terms of size and/or distance and/or reciprocal shape of holes or nozzles.

Finally, the stator according to the present invention will be modifiable according to needs and/or circumstances, wherein the substantially identical elements to be "added", in practice to be superimposed, can be processed beforehand using low-cost technologies, such as metal chemical photoengraving, which ensure machining of very small dimensions with maximum precision.

Although the present invention has been explained above by means of a detailed description of the embodiments depicted in the drawings the present invention is not limited to the embodiments described above and depicted in the drawings. On the contrary, all the modifications and/or variants of the embodiments described above and depicted in the drawings which will appear obvious and immediate to a person skilled in the art have to be regarded as falling within the scope of the present invention.

For example, one or more of the following parameters may be varied according to needs and/or circumstances:

number of lamellar elements 1100 and/or their protrusions 1103;

thickness sp of the protrusions 1103 and/or sl of the respective lamellar element 1100;

orientation of the protrusions 1103 to convey a rightward or alternatively leftward rotary motion to the rotor 102;

the shape of the outer perimeter of the lamellar element 1100, not necessarily circular but also regular or irregular polygonal or including straight lines;

the formation method of the protrusions 1103 (as an alternative to photochemical engraving or etching);

the location of the protrusions which may protrude from the main surface 1102 or, alternatively, from the corresponding opposite surface and/or from both;

the materials of the various component parts.

Furthermore, possible embodiments of the present invention will be possible in which different lamellar elements 1103 may have protrusions 1103 differing in number and/or shape and/or thickness and/or with different locations to define respectively different passages 1101 in the stator 101 itself.

Furthermore, according to the present invention, the discoid (disc shaped) elements 1020 of the rotor 102 may be fixed to one another and/or splined to shaft A in different manners, e.g. by means of pins which extend through through-holes made in each element 1020.

Figure 2A:
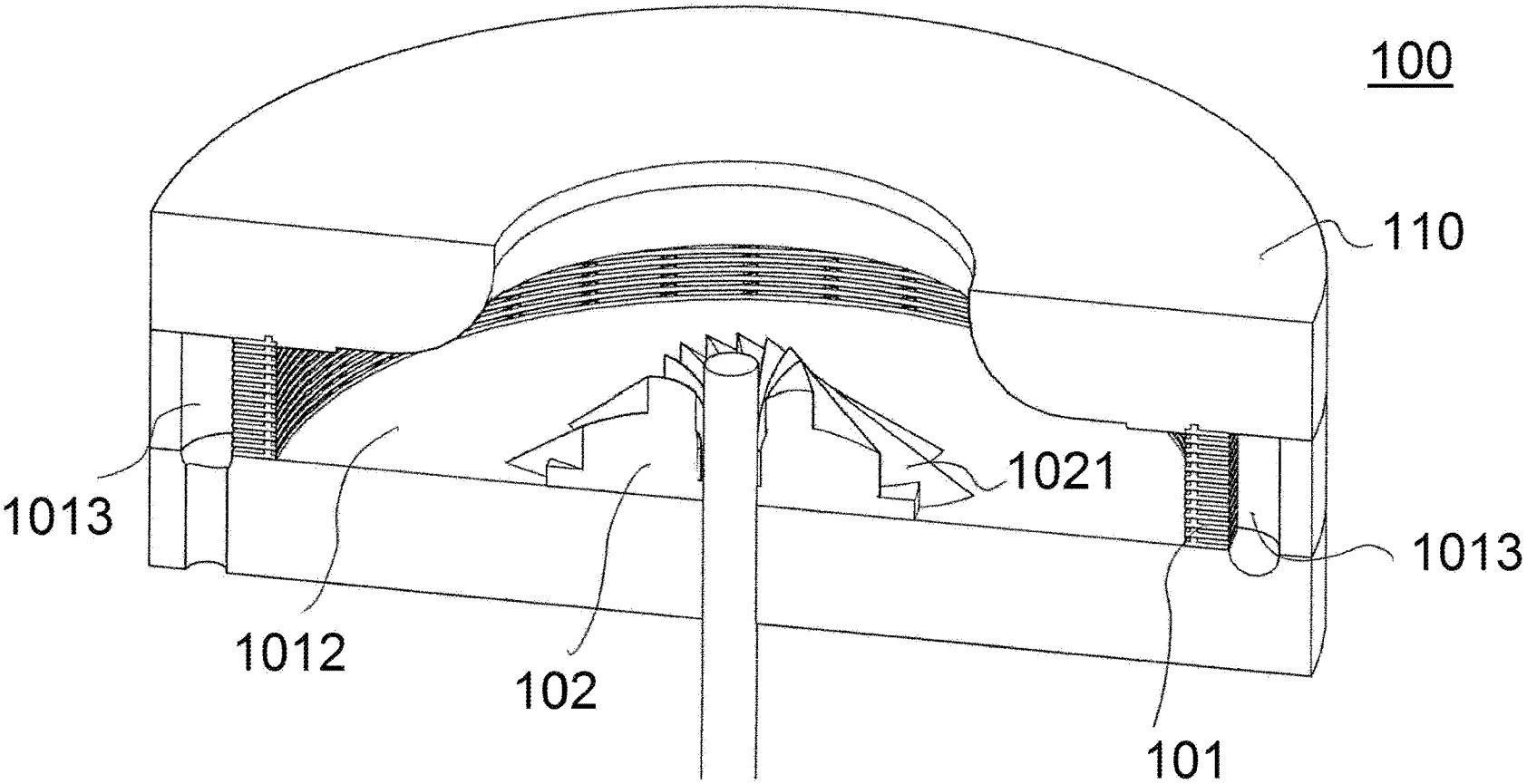
FIGS. 2*a* and 2*b* each show a perspective view in partial section of a machine according to an embodiment of the present invention.
Figure 2B:
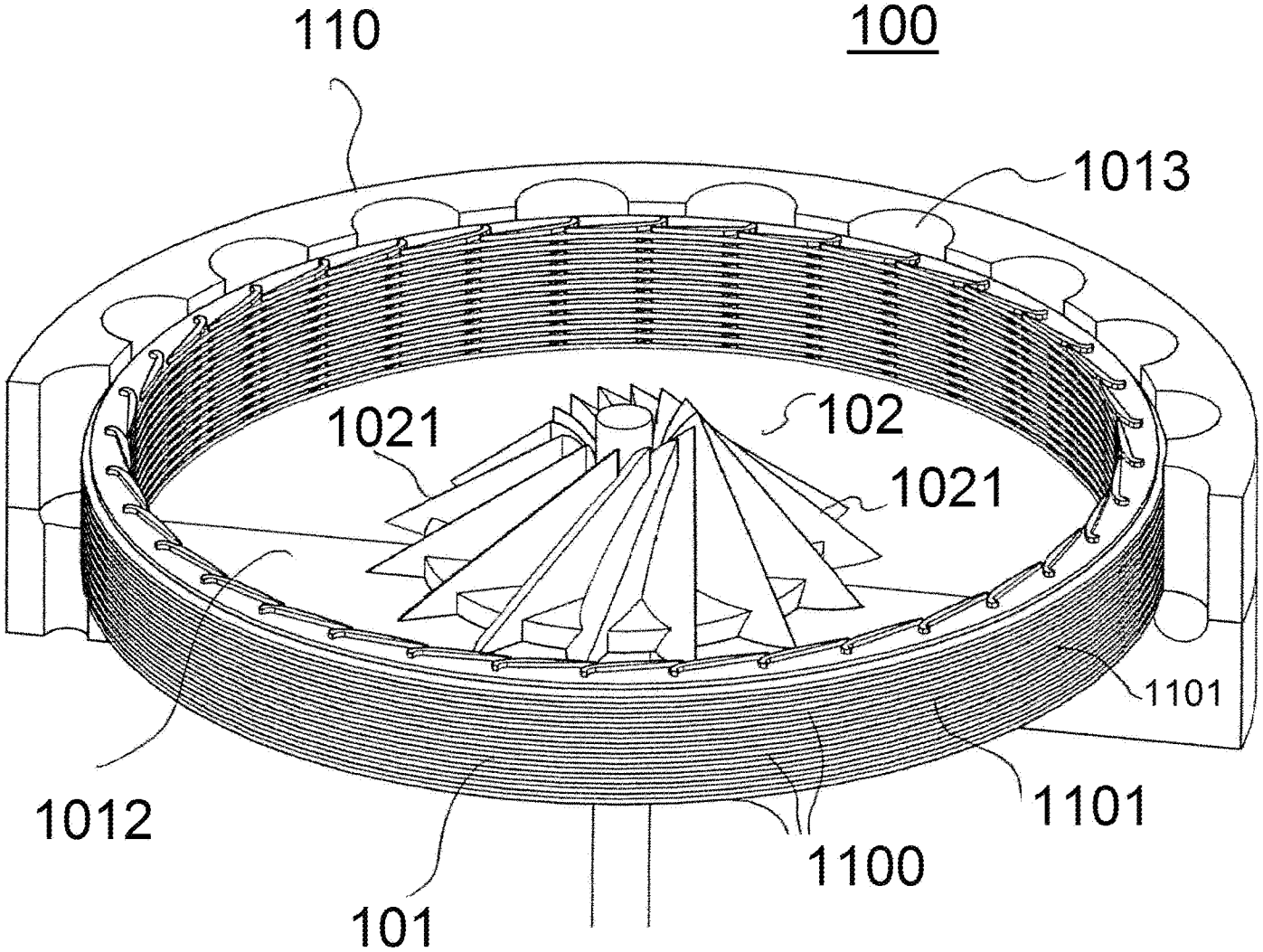

Finally, different rotors may be used as an alternative to the one in FIGS. 1*a* and 1*b*, e.g. a rotor of the type shown in FIGS. 2*a* and 2*b* and therefore comprising radial blades 1021, each parallel to a plane containing the axis X and each delimited by an outer edge lying on a truncated cone surface.

The scope of the present invention is thus defined by the claims.

The invention claimed is:

1. A machine for generating energy by exploiting a flow of a fluid, said machine comprising:

a cylindrical first fixed or static component part or stator, which defines a cylindrical first inner surface and a second outer surface; and a second component part or rotor adapted to be rotated and accommodated in an inner space confined by said first inner surface, said first fixed or static component part or stator being configured to introduce a fluid into the inner space through said second outer surface and said first inner surface, wherein an interaction between a flow of the fluid introduced into said inner space and said second component part or rotor results in said second component part or rotor being rotated, wherein said first fixed or static component part or stator comprises a plurality of overlapping lamellar elements, wherein at least one of said lamellar elements is shaped so as to define non-contact areas with an adjacent one of said lamellar elements so as to define a plurality of passages for said fluid, wherein each of said passages puts into communication said inner space with a space outside said second outer surface, wherein said second component part or rotor comprises a main body accommodated in said inner space and includes a plurality of radial blades, and wherein outer edges in a radial direction of said radial blades lie on a common frustoconical plane.

2. The machine according to claim 1, wherein said at least one of said lamellar elements defines a flat main surface, from which a plurality of protrusions extends.

3. The machine according to claim 2, wherein a thickness of said protrusions is equal to a thickness of said at least one lamellar element at said non-contact areas subtended from said flat main surface.

4. The machine according to claim 3, wherein the thickness of said protrusions is from 0.002 to 2.00 millimeters.

5. The machine according to claim 3, wherein the thickness of said protrusions is from 0.01 to 0.5 millimeters.

6. The machine according to claim 3, wherein the thickness of said protrusions is from 0.025 to 0.3 millimeters.

7. The machine according to claim 2, wherein, in a plan view, each of said protrusions has an elongated shape with a longitudinal development along a directrix perpendicular to a longitudinal symmetry axis of said first fixed or static component part or stator.

8. The machine according to claim 7, wherein each of said protrusions comprises a first end portion disposed proximate to said first inner surface.

9. The machine according to claim 8, wherein each of said protrusions comprises a second end portion disposed at a predetermined distance from said second outer surface.

10. The machine according to claim 7, wherein the longitudinal development along the directrix of each of said protrusions is tangential to said first inner surface and intersects said second outer surface.

11. The machine according to claim 7, wherein adjacent protrusions of said protrusions partially overlap each other according to a radial direction perpendicular to the longitudinal symmetry axis of said first fixed or static component part or stator.

12. The machine according to claim 7, wherein each of the plurality of protrusions extend in a same circumferential direction.

13. The machine according to claim 2, wherein said protrusions are obtained by chemically photoengraving each of the plurality of lamellar elements.

14. A machine for generating energy by exploiting a flow of a fluid, said machine comprising:

a cylindrical first fixed or static component part or stator, which defines a cylindrical first inner surface and a second outer surface; and a second component part or rotor adapted to be rotated and accommodated in an inner space confined by said first inner surface, said first fixed or static component part or stator being configured to introduce a fluid into the inner space through said second outer surface and said first inner surface, wherein an interaction between a flow of the fluid introduced into said inner space and said second component part or rotor results in said second component part or rotor being rotated, wherein said first fixed or static component part or stator comprises a plurality of overlapping lamellar elements, wherein at least one of said lamellar elements is shaped so as to define non-contact areas with an adjacent one of said lamellar elements so as to define a plurality of passages for said fluid, wherein each of said passages puts into communication said inner space with a space outside said second outer surface, wherein said at least one of said lamellar elements defines a flat main surface, from which a plurality of protrusions extends, wherein, in a plan view, each of said protrusions has an elongated shape with a longitudinal development along a directrix perpendicular to a longitudinal symmetry axis of said first fixed or static component part or stator, wherein each of said protrusions comprises a first end portion disposed proximate to said first inner surface, wherein each of said protrusions comprises a second end portion disposed at a predetermined distance from said second outer surface, and wherein said second end portion of each of said protrusions is hook-shaped and defines an end tip facing said second outer surface.

15. The machine according to claim 14, wherein said second component part or rotor comprises a main body accommodated in said inner space and comprising a plurality of overlapping discoid elements, and wherein the discoid elements of pairs of adjacent discoid elements are spaced from one another by a predetermined distance.

* * * * *